US007597658B2

(12) United States Patent
Samways et al.

(10) Patent No.: US 7,597,658 B2
(45) Date of Patent: Oct. 6, 2009

(54) CENTRIFUGAL SEPARATOR AND ROTOR THEREFOR

(75) Inventors: Andrew Samways, Dorchester (GB); Andy Collins, Illminster (GB); Brian Harrison, Illminster (GB); Anthony W. Fell, Yeovil (GB); Martyn Congram, Illminster (GB); Stuart Percy, Poole (GB); John Lawrence Mills, Illminster (GB); Adrian Day, Illminster (GB); Martin Weindorf, Kornwestheim (DE)

(73) Assignee: Mann & Hummel GmbH, Ludwigsburg (DE)

( * ) Notice: Subject to any disclaimer, the term of this patent is extended or adjusted under 35 U.S.C. 154(b) by 249 days.

(21) Appl. No.: 11/404,076

(22) Filed: Apr. 14, 2006

(65) Prior Publication Data

US 2006/0258523 A1 Nov. 16, 2006

(30) Foreign Application Priority Data

Apr. 15, 2005 (GB) ..... 0507611.2

(51) Int. Cl.
*B04B 9/06* (2006.01)

(52) U.S. Cl. ..... 494/49

(58) Field of Classification Search ..... 494/24, 494/36, 43, 49, 56, 64, 65, 67, 83, 84, 901; 210/168, 171, 232, 360.1, 380.1, 416.5; 184/6.24

See application file for complete search history.

(56) References Cited

U.S. PATENT DOCUMENTS 2,723,079 A 11/1955 Fulton et al.
4,288,030 A 9/1981 Beazley et al.
4,400,167 A 8/1983 Beazley et al.
4,787,975 A 11/1988 Purvey (Continued)

FOREIGN PATENT DOCUMENTS

DE 1 093 617 11/1960

(Continued)

OTHER PUBLICATIONS

European search report dated May 26, 2006 (nine (9) pages).

*Primary Examiner*—Charles E Cooley
(74) *Attorney, Agent, or Firm*—Crowell & Moring LLP

(57) ABSTRACT

A rotor (10) for a centrifugal separator (12) for circulated engine lubricant formed by end walls (44, 46) and radially outer and inner side walls (42, 52) that define a separation and containment region (82). Wall (52) is defined by a tubular tension member (50) that surrounds a rotation axis (30) and extends between and through the end walls to keep them in position. Mounted within first and second ends (72, 74) of the tubular tension member are respective first and second end closure plugs (86, 88). Plug (88) has a passage (90) to admit liquid into the tubular member, but otherwise each plug is seated to inhibit passage of liquid from the member end. Each plug comprises a body seated by interference fit and an integral axially extending component (86', 88') that forms a mounting pin for mounting the rotor within bearing parts (24, 28) of the housing. Closure plugs may be assembled from separate plug body and fixed or rotatable mounting pin components and may extend along the tubular member and be coupled to each other, or be formed integrally as a unitary body, or share a common mounting pin that extends between discrete plug bodies.

14 Claims, 5 Drawing Sheets

U.S. PATENT DOCUMENTS

| | | | | |
|---|---|---|---|---|
| 4,871,458 | A * | 10/1989 | Purvey | 210/360.1 |
| 6,074,336 | A * | 6/2000 | Purvey | 494/49 |
| 6,095,964 | A * | 8/2000 | Purvey | 494/49 |
| 6,196,962 | B1 * | 3/2001 | Purvey et al. | 494/49 |
| 6,224,531 | B1 * | 5/2001 | Frehland et al. | 494/49 |
| 6,234,949 | B1 * | 5/2001 | Cox et al. | 494/49 |
| 6,354,987 | B1 | 3/2002 | Frehland et al. | |
| 6,454,694 | B1 * | 9/2002 | Herman et al. | 494/49 |
| 6,457,868 | B1 | 10/2002 | Fischer et al. | |
| 6,530,872 | B2 * | 3/2003 | Frehland et al. | 494/49 |
| 6,740,026 | B2 * | 5/2004 | Samways | 494/12 |
| 2006/0240965 | A1 * | 10/2006 | Herman et al. | 494/49 |
| 2006/0258523 | A1 * | 11/2006 | Samways et al. | 494/49 |

FOREIGN PATENT DOCUMENTS

| | | | |
|---|---|---|---|
| DE | 100 63 903 A 1 | | 7/2002 |
| EP | 0 193 000 | A2 | 9/1986 |
| EP | 1 287 895 | A2 | 3/2003 |
| GB | 710510 | | 6/1954 |
| GB | 1036661 | | 7/1966 |
| GB | 1 507 742 | | 4/1978 |
| GB | 2 049 494 | A | 12/1980 |
| GB | 2406898 | A * | 4/2005 |
| JP | 2000-161039 | | 6/2000 |
| WO | WO94/16822 | | 8/1994 |
| WO | WO 98/46361 | A1 | 10/1998 |
| WO | WO 99/54051 | A1 | 10/1999 |
| WO | WO 00/55515 | A1 | 9/2000 |

* cited by examiner

CENTRIFUGAL SEPARATOR AND ROTOR THEREFOR

BACKGROUND OF THE INVENTION

This invention relates to centrifugal separator apparatus for separating solid contaminants from a pumped liquid, by passage of contaminated liquid through a rotor from which it emerges as a jet that drives the rotor in rotation by reaction to the emerging liquid. The invention is particularly concerned with a rotor for such a self driven separator.

Such self-driven centrifugal separator apparatus is known from, for example, U.S. Pat. No. 4,787,975 (=EP 193,000), U.S. Pat. No. 6,224,531 (=WO 98/46361), U.S. Pat. No. 6,354,987 (=WO 99/54051), U.S. Pat. No. 6,457,868 (=WO 00/55515), U.S. Pat. No. 4,288,030 (=GB 2,049,494), GB 1,036,661, GB 710,510 and DE 10 93 617.

It is common for such separators to be used in cleaning particulates from lubricating oil circulated around an internal combustion engine. Such a separator then commonly comprises base structure that is mounted on the engine block to receive pumped oil at elevated pressure and return cleaned oil to the engine sump.

A cover supported on the base structure defines a housing enclosing a rotor that is free to rotate about an axis extending between the base structure and cover. For reasons known to those skilled in the art the rotation axis is desirably substantially vertical and the rotor is mounted via axially spaced bearings that permit contaminated liquid to enter the rotor substantially at the rotation axis and cleaned liquid to leave the rotor by tangentially directed reaction jet nozzle spaced from the rotation axis.

A considerable number of designs have been proposed to make such separators economical to manufacture and operate, whilst optimising, or at least not detracting from, efficient operation by comprising, rotation efficiency.

Insofar as successful operation results in the rotor filling with separated contaminants, it is necessary periodically to disassemble the housing, remove the rotor and replace it with an empty one, either by opening and cleaning the removed rotor or substituting it by a new one.

One of the approaches to achieving economy of operation is to have a throw-away rotor that requires no maintenance, providing that it can be made cheaply enough and rotate efficiently without requiring an expensive housing to compensate.

Rotor design is also influenced by, or influences, how it is mounted with respect to the housing and in this respect there are two major approaches, although each has variants.

An approach described in the aforementioned U.S. Pat. No. 4,787,975 involves having a solid axle or spindle fixed with respect to the housing and upon which both the rotor and housing cover are located, the axle also serving to direct oil to the rotor via drillings through the axle and provide journal surfaces against which rotor-borne bearing bushes slide. The pressure of supplied oil and/or thrust of the reaction jets may be used to apply weight countering force along the rotor axis and as such the sliding bearing bushes may include flanges to provide thrust bearings between the rotor and the base structure and/or cover.

A variant of this longitudinal fixed axle approach is described in GB 710,510 where a rotor is made of cheap materials and is supported in respect of thrust forces towards the cover by a ball making point contact with the rotor.

An alternative to having such a fixed elongate axle extending through the housing enclosure is to employ shorter stub axles either fixed to the housing or rotatable with the rotor.

U.S. Pat. No. 4,288,030 employs such stub axles formed at the housing structure and cover that co-operate with sliding bearing bushes in end of the rotor, GB 1,036,661 and DE 1093617 each employ such stub axles that form parts of the spaced end walls of the rotor, at least one of the stub axles being hollow to permit entry of the contaminated liquid to the rotor, and lubrication of the bearings in which they slide by controlled leakage of the liquid they contain.

In keeping with having a separator and replacement rotor that is relatively cheap to manufacture, having such stub axles formed as part of the rotor is superficially attractive but such attraction may be lessened by compromises in rotation efficiency.

For example, if a rotor of the type shown in the aforementioned GB 1,036,661 or U.S. Pat. No. 4,288,030 is made from flimsy materials for economy, then the significant internal pressures developed during rotation tend to distort the rotor, including forcing the end walls apart, so that there is increased thrust loading on sliding bearings possibly to the point of jamming.

Rotor manufacture economy also points towards the molding of such rotor in two or more pieces to be joined as a self-contained rotor from synthetic resin (i.e., plastic) materials.

U.S. Pat. No. 6,224,531, U.S. Pat. No. 6,354,987 and U.S. Pat. No. 6,457,868 all disclose examples of centrifugal separators in which the rotors are molded from synthetic resin materials and assembled from few component parts.

The aforementioned U.S. Pat. No. 6,224,531 discloses constructions for a separator employing either a stationary spindle axle fixed to the base structure and stub axle shafts fixed to the rotor.

The aforementioned U.S. Pat. No. 6,354,987 and U.S. Pat. No. 6,457,868 also employ rotors made from molded synthetic resin components, but the rotor and walls have integrally molded stub axle shafts that engage with cooperating bearing parts in the housing base structure and cover. They address improved rotation efficiency by employing a ball race bearing in the cover, which offers low resistance to rotation whilst absorbing axial loads, and a sliding bearing in the base structure that includes a spherical element that effects alignment of the rotor with respect to the cover whilst obviating some of the need for precision of component manufacture.

However, molding such a rotor from synthetic resin materials requires sophisticated molding apparatus, and economy comes from manufacturing components in large numbers.

It will be appreciated that the rotor design disclosed in the aforementioned U.S. Pat. No. 4,787,975, although somewhat dated in terms of materials, may be made economically by less sophisticated methods, from relatively cheap thin sheet steel and the like, although not of course limited to any such material.

SUMMARY OF THE INVENTION

It is an object of the present invention to provide an improved rotor for a self-driven centrifugal separator of the type having a housing comprising a base structure and a removable cover defining an enclosure in which the rotor is able to rotate about an axis extending between the base structure and cover via rotor mounting bearings having parts located in the base structure and cover.

Another object of the invention is to provide a rotor of simple design that may be produced economically.

A further object of the invention is to provide a self-driven centrifugal separator including such a rotor.

According to a first aspect of the present invention, a rotor for a self driven centrifugal separator (the separator being of the type having a housing comprising a base structure and a removable cover defining an enclosure in which the rotor is able to rotate about an axis extending between the base structure and cover via rotor mounting bearing parts located in the base structure and cover) comprises:

(i) an outer side wall, surrounding and spaced from a central rotation axis, (ii) axially spaced first and second annular end walls spaced apart along the rotation axis, each end wall extending radially inwardly from said outer side wall and terminating at a boundary of an opening centered on the rotation axis, and (iii) a unitary tubular tension member having a member wall surrounding the rotation axis, axially extending between and through said first and second end wall openings, said member wall having first and second ends respectively securing said first and second end walls against separation during rotor operation;

said tubular tension member wall comprising a boundary of an inlet region within the member and an inner side wall of an annular separation and containment region between said side and end walls, said tubular tension member wall also having at least one transfer aperture therethrough and at least one of the outer side wall and first and second end walls having at least one substantially tangentially directed reaction jet nozzle;

the tubular tension member carrying therein in the vicinity of a first end thereof a first end closure plug operable to inhibit the passage of liquid through said first end of the tubular tension member and carrying in the vicinity of the second end a second end closure plug operable to inhibit passage of liquid through said second end of the member other than by a way of a passage extending axially through the plug to the inlet region, and at least one of said closure plugs having a portion thereof centered on the rotation axis defining a mounting pin extending axially beyond the respective end of the tubular tension member and dimensioned to locate in, and support the rotor with respect to, a respective separator mounting bearing part.

According to a second aspect of the present invention a self driven centrifugal separator comprises a housing comprising a base structure, a removable cover defining an enclosure, rotor mounting bearings having parts located in the base structure and cover, and a rotor according to the preceding paragraph mounted in said bearing parts and operable to rotate about an axis extending between them.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figure 1:
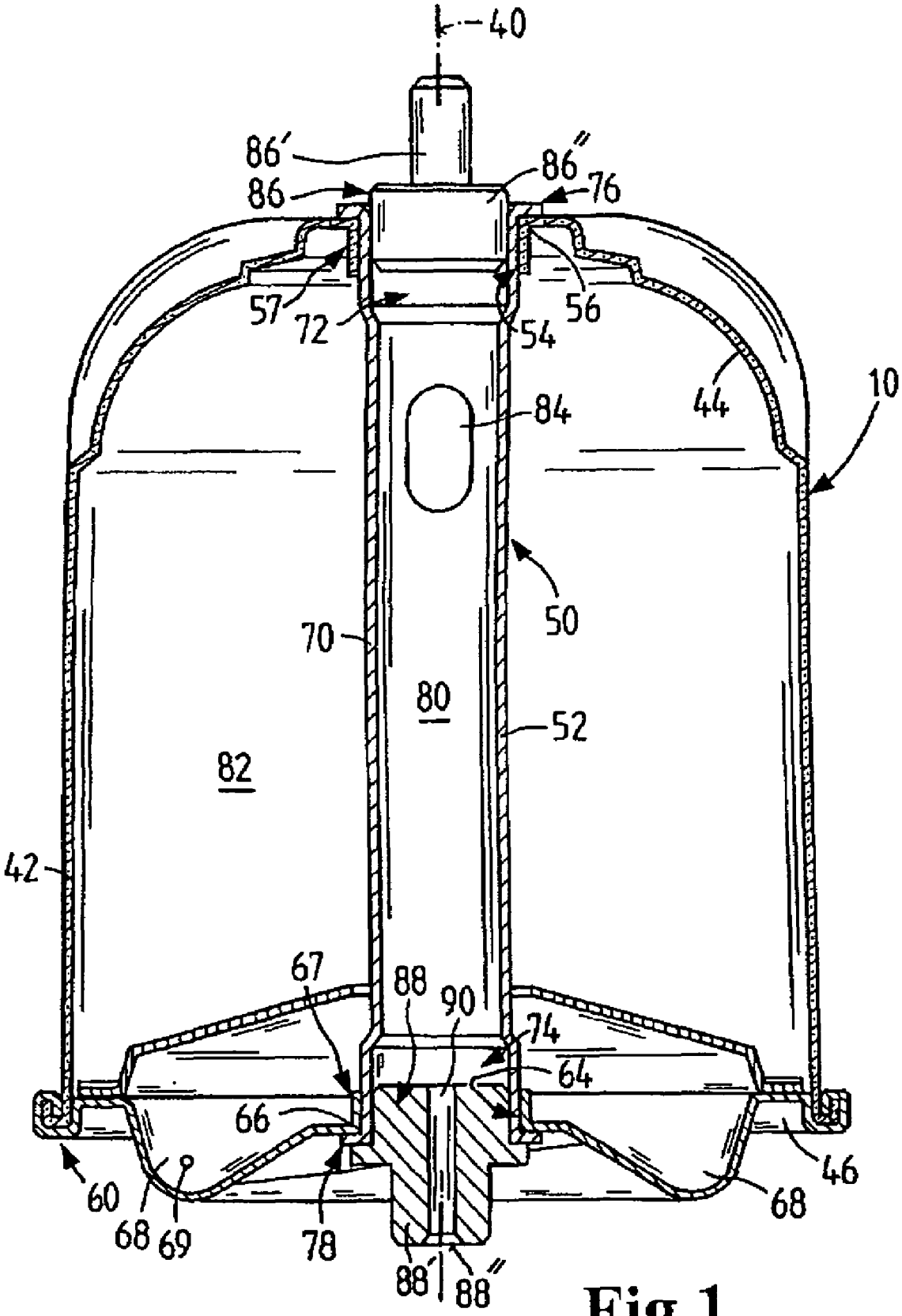
FIG. 1 is a sectional elevation through a first embodiment of centrifugal separator rotor in accordance with the present invention, employing separate first- and second-end closure plugs formed as unitary bodies.
Figure 2:
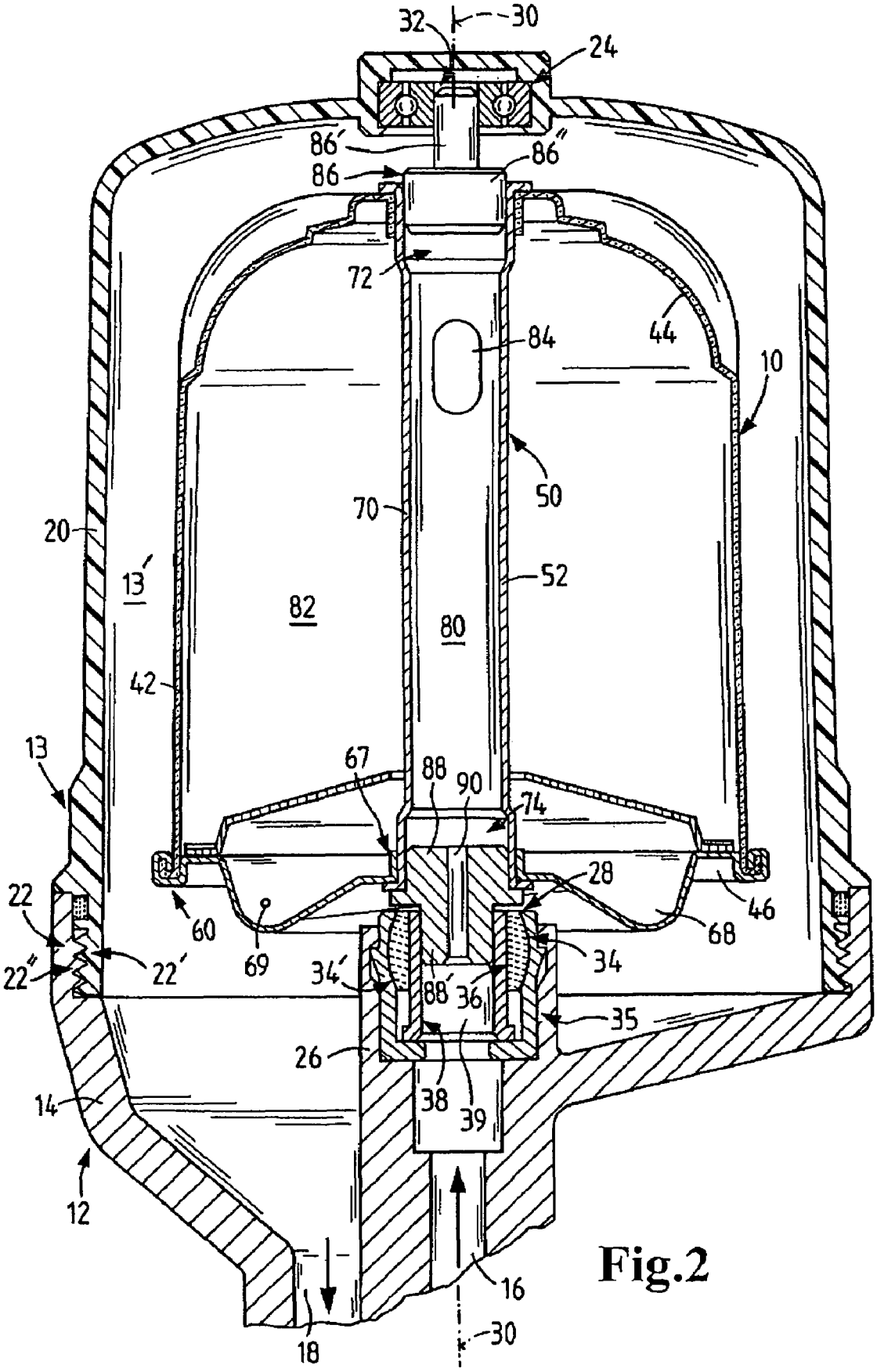
FIG. 2 is a sectional elevation through a self driven centrifugal separator also in accordance with the present invention, incorporating the rotor of FIG. 1.

Referring to FIGS. 1 and 2, rotor 10 is shown in FIG. 2 mounted in position as part of a centrifugal separator 12. The centrifugal separator 12 comprises a housing 13 that defines an enclosure 13' and mounting points for the rotor. The housing 13 has a base structure 14 which for operation is secured to an internal combustion engine block (not shown) from which it receives a supply of oil at elevated pressure via inlet duct 16 and returns oil to the engine block sump through drain duct 18. The housing also comprises a generally cylindrical cover 20 which is removably mounted with a respect to the base structure at an interface 22, defined by screw thread arrangement 22' at one end of the cover and screw thread arrangement 22" on the base structure.

At the other end of the cover and centrally thereof is located a ball bearing arrangement 24. Centrally of the base structure there is provided an upstanding receptacle 26 in which is mounted a sliding bearing arrangement indicated at 28. The bearing arrangements 24 and 28 of the assembled housing form parts of a rotor mounting bearing and define a bearing axis 30 extending through the housing enclosure.

The mounting bearing part that is the ball bearing arrangement 24 comprises a ball race supported fixed with respect to the cover and a through aperture 32 that defines one end of the axis.

The mounting bearing part that is the sliding bearing arrangement 28 comprises a hollow cylindrical bush 34 of bronze or like bearing material carried in the base structure receptacle, the bush having a longitudinally extending aperture 36 therethrough that is substantially coaxial with the center of the receptacle and containing a hollow cylindrical body 38 of steel that extends through the bush aperture 36 in sliding relationship, at least rotatably. The hollow cylindrical body 38 defines a through-aperture 39 that is open at each end and aligned with the inlet duct 16 so that liquid supplied to the base structure flows through the cylindrical body.

The apertures 32 and 39 of the bearings 24 and 28 thus define the bearing axis 30 of the housing enclosure extending therebetween, notwithstanding that the position of the bearing 24 may vary with respect to bearing 28 to a minor degree each time the cover is attached to the base structure.

Optionally, the bush 34 has a part-spherical outer surface 34' that co-operates with a carrier 35 mounted fixedly in the base structure receptacle to permit limited variation of inclination of the cylindrical body through-aperture 39 to align it with the cover bearing aperture 32 and thus the bearing axis 30.

Insofar as the bearing axis is defined by and between the spaced apart bearings 24 and 28, mounting the rotor 10 via the bearings defines a rotation axis therefor coincident with the bearing axis as defined by the bearing apertures 32 and 39.

Also optionally, as shown in this embodiment, the hollow cylindrical body 38 is also slideable with respect to the bush 32 longitudinally.

Considering also FIG. 1, the rotor 10 is of generally cylindrical form, generated about a central longitudinal axis therethrough that effects rotor rotation axis 40, and comprises: an outer side wall 42, surrounding and spaced from the central rotation axis 40; first and second annular end walls, 44 and 46 respectively, spaced apart along the rotation axis, each end wall extending radially inwardly from said outer side wall and terminating at a boundary of an opening centered on the rotation axis 40; and a tubular tension member 50, discussed in greater detail below, that defines an inner side wall 52 of the rotor as well as a carrier for mounting the rotor in the housing.

The outer wall 42 is made of sheet steel and the first end wall 44 is formed integrally therewith, being pressed to shape, end wall opening 54 being defined by a terminating boundary 56 in the form of an axially extending flange 57. The second end wall 46 is formed separately from a pressed steel sheet and joined at the outer periphery thereof to the outer side wall by folded seam 60. The second end wall defines an opening 64 at its radially inward boundary 66 by way of axially extending flange 67. Furthermore, the second end wall 46 is also pressed to include angularly about the opening 64 progressively deepening channels 68 each of which terminates in a reaction jet nozzle 69 directed tangentially with respect to the rotation axis.

The tubular tension member 50 is a unitary member having a member wall 70 surrounding the rotation axis 40, the tension member extending between and through the first and second end wall openings 54 and 64 at first and second ends indicated at 72 and 74 respectively. At the first end 72 the tubular member is a press fit in the opening 54, its wall 70 abutting the end wall flange 57, and at its end the wall 70 is out-turned as a flange 76 overlying the first end wall adjacent the opening. At its second end 74, the tubular tensioning member is a press fit in the aperture 64 of the second end wall 46 and the end of the member is out-turned as a flange 78 overlying the second end wall.

The tubular tension member wall 70 comprises the outer boundary of an inlet region 80 within the member and also comprises the aforementioned inner side wall 52 that bounds an annular separation and containment region 82 defined between the side and end walls. The member wall 70 also has at least one transfer aperture 84 therethrough extending between the inlet region 80 and the separation and containment region 82.

It will be appreciated that in operation of the rotor, oil is supplied at elevated pressure to the inlet region 80 and transferred to the region 82 from which it is forced through nozzle 69 by the high pressure developed within the rotor by the rotation. Thus, when it is filled with liquid and rotated at high speed, significant internal pressures are developed which tend to deflect the side and end walls of the rotor, particularly tending to force apart the end walls 44 and 46, and to this end the tension member 50 serves to secure the first and second end walls against such separation during rotor operation whilst the forces exerted by the walls on the tubular tension member improve the liquid tightness of the rotor, even if the end walls, carried by the outer side wall, do not have great structural strength per se. The use of such a tension member for this purpose is disclosed in the aforementioned U.S. Pat. No. 4,787,975.

Where the rotor 10 differs in respect of the present invention is that the tubular tension member 50 carries therein in the vicinity of the first end 72 a first-end closure plug 86 that is operable to prevent the passage of liquid through the first end of the tension member and carries in the member in the vicinity of the second end 74 a second-end closure plug 88 that is operable to prevent the passage of liquid through the second end of the tension member other than through a passage 90 extending axially through the plug to the inlet region 76.

In this illustrative embodiment each closure plug 86 and 88 is formed as a unitary metal body and at least one, and preferably each, of the closure plugs is mounted in position with respect to the tubular tension member wall 70 and secured with respect thereto as a press or interference fit, conveniently one that exerts such a force on the tubular member wall 70 that forces it against, and tightly wedges it between, the plug and the end wall boundary flange 57, 67 respectively to ensure both physical location and a seal against passage of the liquid oil from the inlet region through the plug-wall interface.

The closure plug 86 has a portion 86' centered on the rotation axis 40 extending axially beyond the end of the tubular tension member as a first end mounting pin dimensioned to locate in the aperture 32 of ball bearing arrangement 24 to support the rotor with respect to that bearing. The plug 86 thus comprises a plug body portion 86" that is seated within the tubular tension member and integrally therewith the mounting pin portion 86'. The closure plug 88 has a plug body portion 88" seated within the tubular tension member and integrally therewith a mounting pin portion 88' extending axially beyond the second end of the tension member and forming a second end mounting pin dimensioned to locate in the through-aperture 39 of cylindrical body 38 of the housing structure sliding bearing. The passage 90 extends through the second end mounting pin and opens at the end $\mathbf{88}_E$ thereof.

The first-end mounting pin 86' is preferably able to slide freely along the aperture 32 and where this is the case the body of the plug extends beyond the first end of the tubular member to form a shoulder operable to form an axial sliding limit with respect to the ball bearing arrangement should the rotor move axially during operation into contact therewith. The mounting pin 86' is, however, not so freely slideable relative to the ball bearing arrangement in a rotational direction, and is intended to rotate therewith to effect relative rotation between the rotor and cover.

The second-end mounting pin 88' is a slideable, but relatively tight, fit within the cylindrical body 38 to facilitate assembly, but thereafter both axial and rotational movement between the rotor and housing is accommodated by relative motion between the cylindrical body 38 and bush 34 rather than between the plug mounting pin and the cylindrical body.

Thus, the rotor is mounted to rotate within the housing with little resistance, and is able to undertake small axial movements with respect to the mounting bearings according to forces acting on the rotor as a whole, but is, in the critical axial direction, dimensionally rigid and able to be used in a housing dimensioned to receive a rotor made to greater dimensional tolerances and rigidity.

In the embodiment just described, each closure plug is formed as a unitary body of metal with the portion defining the mounting pin integral with the remainder. It will be appreciated that the separate first-end closure plug and second-end closure plug may each be made from a variety of materials, as well as using the same, or different, materials for the pair and alternatively or additionally provided by a variety of physical constructions. The tubular tension member is also open to variation.

Figure 3:
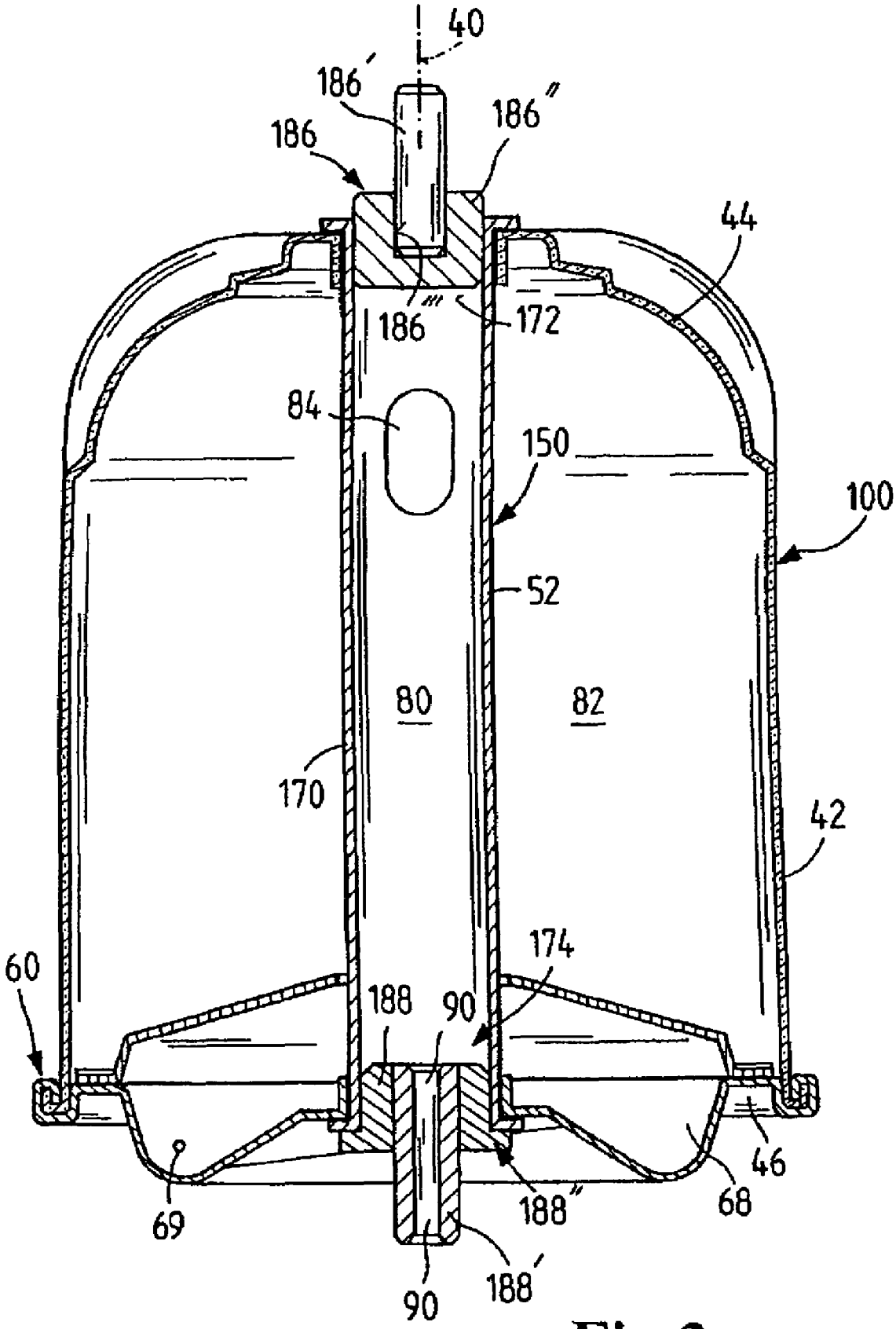
FIG. 3 is a sectional elevation through a second embodiment of centrifugal separator rotor in accordance with the present invention, employing separate first- and second-end closure plugs formed as assembled bodies.

Referring to FIG. 3, this shows in sectional elevation a second embodiment of rotor according to the invention at 100. Those components that are the same as the first embodiment have the same reference numbers and are not discussed again; components that are different have reference numbers with a leading "1".

The rotor 100 has a tubular tension member 150 defined by wall 170 that is of substantially uniform cross section along its length but otherwise formed and fitted to the first and second end walls 44 and 46 in the same or functionally similar manner as member 50.

A first-end closure plug 186 is disposed retained within the first end 172 of the tubular tension member 150 and second-end closure plug 188 is disposed retained within second end 174 of the tubular tension member.

At least one, and conveniently each, of the closure plugs 186 and 188 is formed in two or more component parts. The plug 186, for example, may be formed with its longitudinally extending pin 186' separable from the surrounding plug body 186" such that the plug is assembled before, during or after being placed in position in the tubular tension member 150. The plug body 186" may be a unitary annular body having an aperture 186''' centered on the rotation axis 40 into which the pin is seated. The aperture may be a through-aperture or terminate within the plug body. Such a discrete mounting pin may be secured to the remainder of the plug body mechanically and/or adhesively so as to permanently fixed with respect thereto, fixed but separable, or remain relatively movable. The body 186" may be split longitudinally into two or more segments assembled within the tubular tension member and the mounting pin may be 186' may be likewise split into longitudinal segments, possibly integral with segments of the body 186".

A configuration may be effected where a rotor is made to a design based upon the aforementioned EP0193000 with the tubular tension member containing at each of the first and second ends an annular bearing bush having a central through-aperture. That is, an end closure plug may be provided by inserting a pin such as 186' or 188' into such a bush and securing it with respect thereto.

As thus far described, the rotor mounting is defined by discrete first-end and second-end closure plugs. It will be appreciated that it is possible to provide both a first-end closure plug and a second-end closure plug coupled to each other with the tubular tension member, interconnecting, by forming as a single, unitary plug or by sharing components common to both, depending upon how the tubular tension member varies in cross section along its length.

Figure 4:
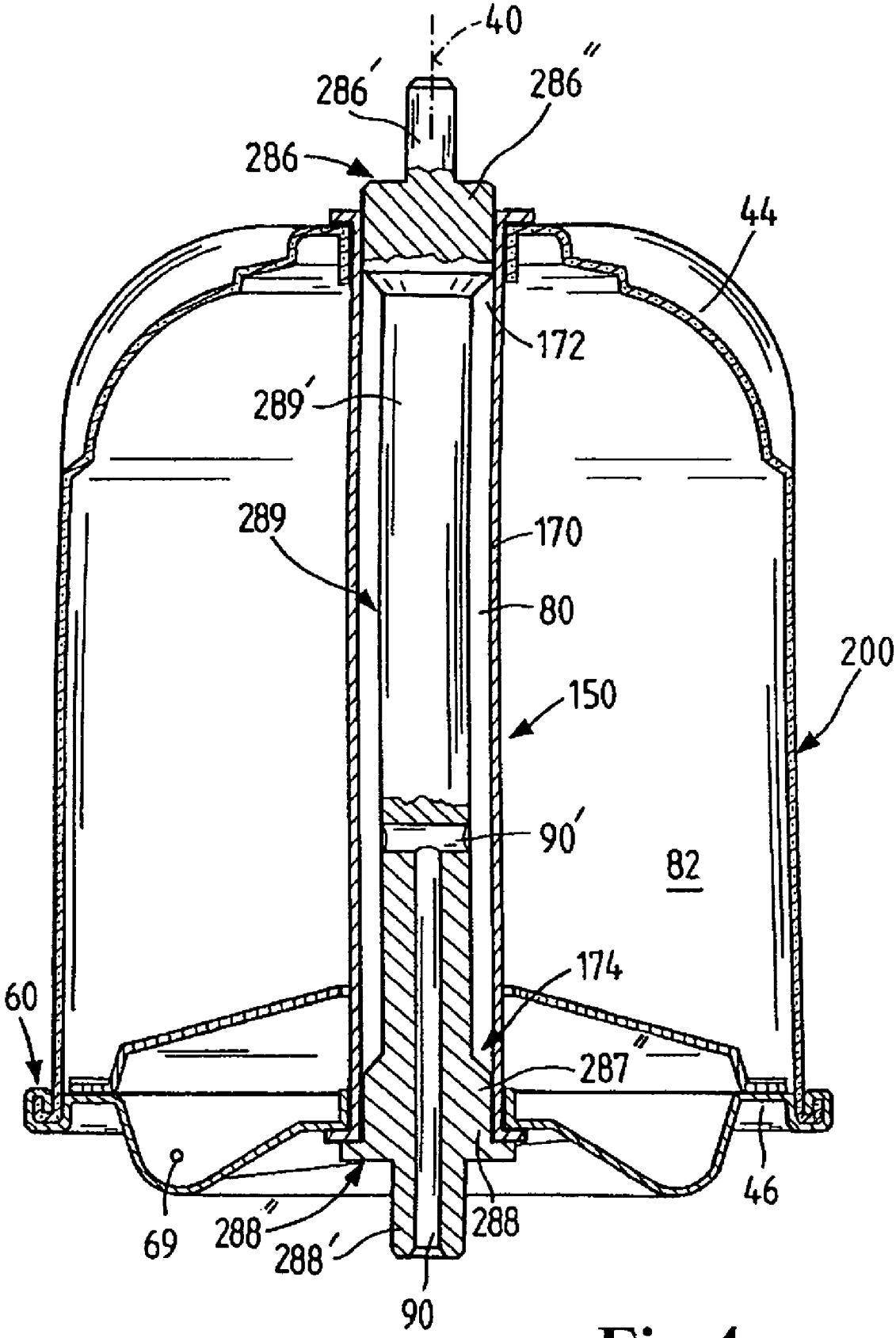
FIG. 4 is a sectional elevation through a third embodiment of centrifugal separator rotor in accordance with the present invention, employing first- and second-end closure plugs formed as a unitary body.

Referring to FIG. 4, this shows a third embodiment of rotor 200 in which the walls and tubular tension member are as for rotor 100 and in which a first-end closure plug 286 and second-end closure plug 288 are provided by a unitary closure plug 289, being coupled within the tubular tension member by a longitudinally extending shaft 289'. The shaft at its ends forms respective first-end and second-end mounting pins 286' and 288' and is supported with respect to the tubular tension member 150 at said ends by enlargements 286" and 287" that form plug bodies. Such a closure plug is mounted in place by introducing it into the tubular tension member from one end thereof. As seen in FIG. 4, the one-piece member 289 has a reduced diameter axial region 289' with an outer diameter which is smaller than an outer diameter of the first end closure plug 286 such than an open annular region 80 is formed between the reduced diameter axial region and the tubular tension member wall 150.

It will be appreciated that the structure of this third embodiment may be varied by separating the shaft 289' into two parts at some point between the plug body enlargements, or even within one of them, so that they are coupled within the tubular tension member and provide in effect discrete plugs with either one or both plugs having in effect a continuation of the mounting pin into and extending along the tubular tension member. Such inwardly extending pin continuation or continuations may be securable with respect to the other before or after insertion to effect such a continuous shaft and maintain the positions of the end closures and mounting pins longitudinally with respect to each other.

Figure 5:
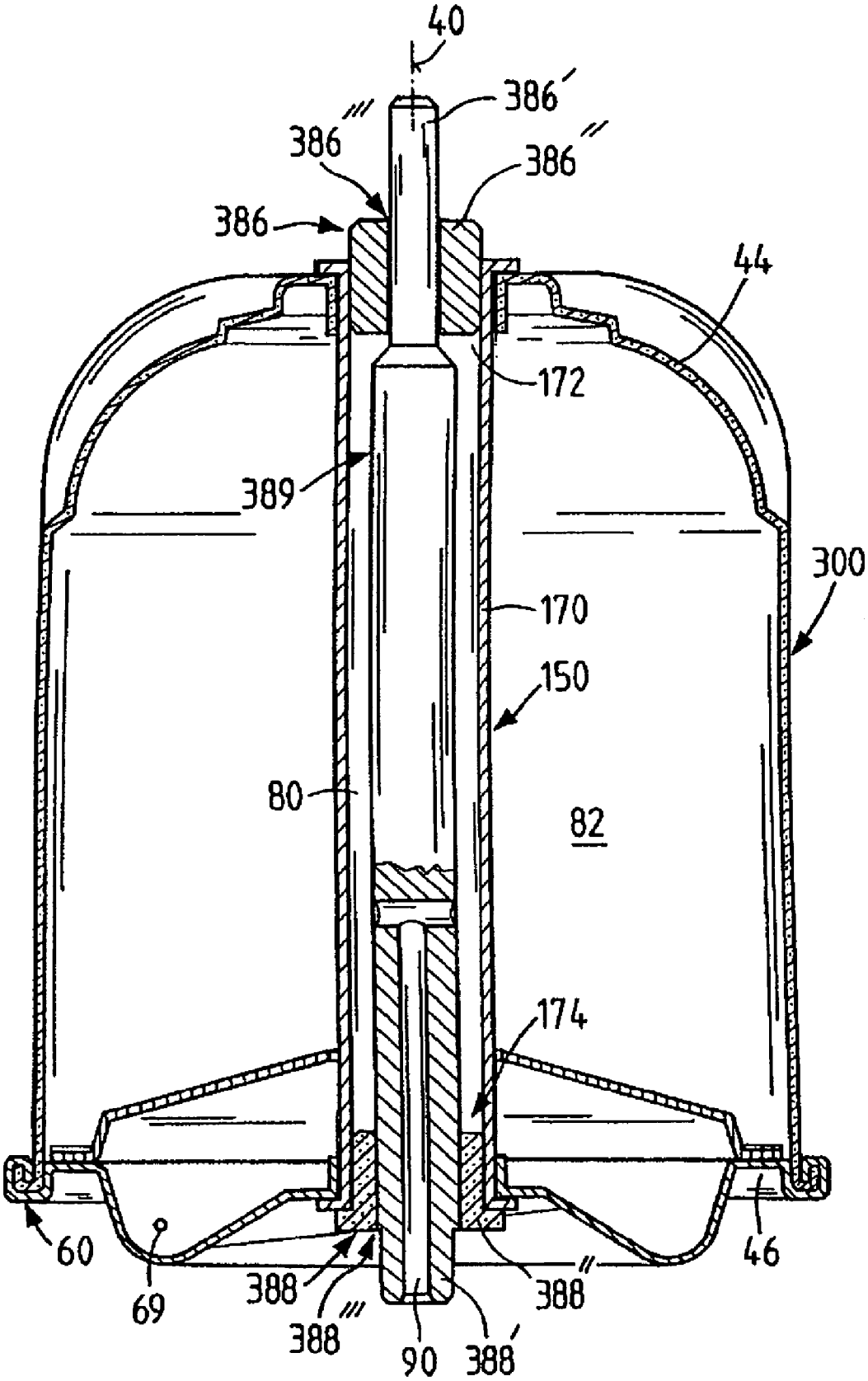
FIG. 5 is a sectional elevation through a fourth embodiment of centrifugal separator rotor in accordance with the present invention, employing first- and second-end closure plugs assembled from shared bodies.

An alternative construction, in which the first-end and second-end closures are not discrete but assembled from components, some of which are shared, is shown in sectional elevation in a fourth embodiment of rotor illustrated at 300 in FIG. 5. The rotor 300 is generally similar to the rotor 100 described above insofar as it has a tubular tension member 150 in which is disposed at its first end 172 a first-end closure plug 386 comprising an annular plug body component 386" having a through-aperture 386''' centered on the rotation axis and at the second end 174 a second-end plug 382 comprising an annular plug body component 388" having through-aperture 388''' centered on the rotation axis. The through-apertures may be of different sizes.

A shaft 389 is inserted via the largest (if appropriate) plug body aperture and extends along the tubular tension member passing through the other plug body. The shaft is longer than the tubular tension member and its ends 386' and 388' are dimensioned to provide the first-end and second-end mounting pin components respectively.

In this embodiment the annular plug bodies 386" and 388" comprise bearing bushes according to the rotor construction of the aforementioned U.S. Pat. No. 4,787,975. The through-apertures are thus circular in cross section as are the respective shaft ends where they pass through the bushes to effect a sliding fit that gives a satisfactory degree of closure for inhibiting passage of liquid from the inlet region 80, having only minor leakage at the interface that also provides lubrication in respect of rotation of each bush with respect to the shaft. Thus, when mounted with respect to the housing the tubular tension member, walls and contents of the rotor are able to rotate with respect to the mounting pins provided by the shaft ends and the pins are able to rotate relative to the housing.

It will be appreciated that if desired, one or both annular plug body components 386" and 388" may be other than bearing bushes, and whether or not they are, the shaft 389 may be secured to one or both bodies it passes through to fix it in respect of rotation in a manner discussed above for individual mounting pins 186' and 188' of rotor 100.

It will also be appreciated that earlier described the rotor 100 may be constructed such that one or each annular plug body component 186" or 188" is formed as a bearing bush and one or each mounting pin component 186' and 188' formed such that it can rotate with respect to the bush, that is, the mounting pin can 'float' rotationally with respect to the rotor walls and the separator housing.

Apart from constraints imposed by inserting a closure plug defined by a unitary body, such as 286 and 288, from one end of the tubular tension member, it is open to vary the cross section shape and dimensions of the tubular tension member along its length and it may departs from the forms illustrated herein.

As mentioned above, the closure plug for each end of the tubular tension member may be made of a metallic or synthetic resin material and, if of an assembled form, may employ components of the same or different materials. Likewise, the rotor walls and/or tubular tension member may be formed of different materials from each other, including metallic materials other than steel and non-metallic materials. It also will be appreciated that there are different methods for mounting each closure plug with respect to the tubular tension member, some methods being more or less suited to specific plug and mounting pin materials.

In the illustrated first embodiment of rotor 10 each closure plug 86 and 88 has a body formed from a metal material and each is mounted in the tubular tension member as an interference fit. Such a closure plug body may, alternatively, engage mechanically by inter-engagement of pronounced surface features of the tubular tension member wall 70, such as screw threads or bayonet-type projections and recesses. Insofar as it is the intention of the first-end closure plug and the second-end closure plug to inhibit escape of liquid from the region 80 within the tubular tension member, this may be effected by a completely liquid-tight configuration that prevents the passage of any liquid or, where appropriate, adopt the prior art practice to permit minor leakage of liquid via the ends of the tubular tension member. Although bearing lubrication not required with ball bearing arrangement 24, each closure plug may be fitted with respect to the tubular tension member wall in a not absolutely liquid tight manner, although it is also possible to secure the plug with respect to the wall of the tubular tension member and/or the pin with respect to the plug body with a sealant, and/or by bonding at the interface using a synthetic adhesive at their interface or effecting temporary melting of the materials or an intermediate filler at their interface.

The housing structure as illustrated in FIG. 2 is substantially the same as that described and illustrated in the aforementioned U.S. Pat. No. 6,354,987 and U.S. Pat. No. 6,457,868, insofar as they illustrate the use of a ball bearing arrangement in the cover and a sliding bearing arrangement in the housing structure receptacle that has a spherical surface for pivoting.

It will be appreciated that the rotors 10, 100, 200 or 300 may be used equally with the bearing variants also disclosed in those publications, namely that ball bearing arrangement 24 being pivotably mounted via spherical surfaces in the cover. Furthermore, as described in those publications and U.S. Pat. No. 6,224,531, the sliding bearing bush 34 may be mounted non-pivotably with respect to the housing structure receptacle 26

Insofar as the rotors described for the principal embodiments of the above publications are intended to have the ability to slide axially within the respective bearing apertures, it is convenient to manufacture a rotor of the present invention with the mounting pins of the closure plugs dimensioned to behave in the same way.

However, variations may be made to the described rotor and mounting to permit its use with variants in configuration of mounting bearing parts in the housing and cover.

It will be appreciated that, as also set out in those documents, that the ball bearing arrangement 24 is able to absorb significant axial load without impairing rotation efficiency. To this end the first closure plug mounting pin 86' (or equivalent of the other embodiments) and/or the ball bearing aperture 32 may be shaped and dimensioned such that the pin seats within the aperture without permitting axial sliding during operation.

In respect of the sliding bearing 28 within the housing structure, the hollow cylindrical body 38 may be dispensed with if the mounting pin 88' of the second end closure plug is made from a material suitable for bearing directly on the bush 34.

The bearings 24 and 28 may be of the same type as each other, that is both as sliding bearings or both as ball-bearings (or analogous roller-bearings). For example, a lower cost or replacement cover may be provided in which the above described ball-bearing arrangement 24 is replaced by a sliding bearing arrangement comprising a bush in the cover that is lubricated by the materials of the bush and/or by oil or oil mist present with the housing enclosure during use. In such a case the first-end mounting pin may comprise a bearing pin to make direct sliding contact with the bush.

As discussed above, the first-end and second-end closure plugs may be of different constructions and the optimum construction for each may depend upon the bearing in which it is to be mounted or form a part. For example, in an embodiment of centrifugal separation also described in the above mentioned U.S. Pat. No. 6,354,987, the hollow cylindrical body 38 does not receive therein a mounting pin projecting from the rotor but itself projects into a recess in the end of the rotor. It will be appreciated that in a rotor in accordance with the present invention the second-end closure plug 88 may be formed without the mounting pin 88' during manufacture, but with a simple recess in the end of the plug to receive the hollow cylindrical body 38 of the housing structure sliding bearing as the mounting pin when the rotor is installed in the housing for use.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A rotor for a self driven centrifugal separator, the separator being of the type having a housing comprising a base structure and a removable cover defining an enclosure in which the rotor is able to rotate about an axis extending between the base structure and cover by way of rotor mounting bearing parts located in the base structure and cover, said rotor comprising:

(i) an outer side wall, surrounding and spaced from a central rotation axis, (ii) axially spaced first and second annular end walls spaced apart along the rotation axis, each end wall extending radially inwardly from said outer side wall and terminating at a boundary of an opening centered on the rotation axis, and (iii) a unitary tubular tension member having a member wall surrounding the rotation axis, axially extending between and through said first and second end wall openings, said member wall having first and second ends respectively securing said first and second end walls against separation during rotor operation, said tubular tension member wall defining a boundary of an inlet region within the member and an inner side wall of an annular separation and containment region between said side and end walls, said tubular tension member wall also having at least one transfer aperture therethrough, and at least one of the outer side wall and first and second end walls having at least one substantially tangentially directed reaction jet nozzle;

the tubular tension member carrying therein:

(a) in the vicinity of a first end thereof a first-end closure plug operable to inhibit the passage of liquid through said first end of the tubular tension member, and (b) in the vicinity of the second end a second-end closure plug operable to inhibit passage of liquid through said second end of the member other than through a passage extending axially through the plug to the inlet region; wherein the first-end closure plug and the second-end closure plug are formed as a one-piece member, the one-piece member having a reduced diameter axial region with an outer diameter which is smaller than an outer diameter of the first end closure plug such than an open annular region is formed between the reduced diameter axial region and the tubular tension member wall, and both of said closure plugs having a portion thereof centered on the rotation axis defining a mounting pin extending axially beyond the respective end of the tubular tension member and dimensioned to locate in, and support the rotor with respect to, a respective separator mounting bearing part.

2. A rotor as claimed in claim 1, wherein at least one of said first-end and second-end closure plugs comprises a plug body mounted within the tubular tension member and a mounting pin integral therewith.

3. A rotor as claimed in claim 1, wherein the plug body of at least one of the first-end and second-end plugs comprises a metal body.

4. A rotor as claimed in claim 1, wherein the tubular tension member comprises a metal tube.

5. A rotor as claimed in claim 1, wherein at least one of the first-end and second-end closure plugs is mounted in fixed axial position within the tubular tension member.

6. A rotor as claimed in claim 5, wherein at least one of the first-end and second-end closure plugs is mounted seated against the axially extending wall of the tubular tension member.

7. A rotor as claimed in claim 6, wherein at least one of said first-end and second-end closure plugs is mounted in the tubular tension member by mechanical interengagement with the tubular tension member wall.

8. A rotor as claimed in claim 7, wherein at least one of said first-end and second-end closure plugs is fitted in an interference fit inside the tubular tension member.

9. A rotor as claimed in claim 5, wherein the tubular tension member wall passes through the opening in said first or second end wall and is clamped between the closure plug and the opening boundary.

10. A rotor as claimed in claim 1, the mounting pin of at least one of the first-end and second-end closure plugs is arranged to be co-operable with a sliding friction bearing part of said housing.

11. A rotor as claimed in claim 1, wherein said second-end closure plug has a mounting pin through which extends said liquid passage.

12. A rotor as claimed in claim 11, wherein the outer surface of said mounting pin of the second-end closure plug is arranged to provide a bearing surface exposed in use to receive said liquid as a bearing lubricant.

13. A self driven centrifugal separator having a housing comprising a base structure and a removable cover defining an enclosure, rotor mounting bearings having parts located in the base structure and cover, and a rotor according to claim 1 mounted in said bearing parts and operable to rotate about an axis extending between them.

14. A separator as claimed in claim 13, wherein the mounting pin of at least one of the first-end and second-end closure plugs of the rotor is arranged to be co-operable with a sliding friction bearing part of said housing.

* * * * *